US005301519A

United States Patent [19]

Howorka

[11] Patent Number: 5,301,519

[45] Date of Patent: Apr. 12, 1994

[54] GOLF BAG COOLER

[76] Inventor: David J. Howorka, 1730 N. Clark St., Ste. 307, Chicago, Ill. 60614

[21] Appl. No.: 981,232

[22] Filed: Nov. 25, 1992

Related U.S. Application Data

[63] Continuation-in-part of Ser. No. 930,207, Aug. 13, 1992.

[51] Int. Cl.[5] ..... F25D 3/08

[52] U.S. Cl. ..... 62/457.5; 62/530; 220/739; 220/903

[58] Field of Search ..... 62/457.2, 457.4, 457.5, 62/530; 220/739, 903

[56] References Cited

U.S. PATENT DOCUMENTS

| | | | |
|---|---|---|---|
| D. 288,653 | 3/1987 | Crymes | D7/77 |
| D. 293,851 | 1/1988 | Cannon et al. | D3/37 |
| D. 311,300 | 10/1990 | Anderson | D7/605 |
| 3,578,199 | 5/1971 | Duncan | 220/739 |
| 3,899,098 | 8/1975 | Hutchins | 220/4.21 |
| 3,938,869 | 2/1976 | Josey | 312/100 |
| 4,383,422 | 5/1983 | Gordon et al. | 62/457.4 |
| 4,383,563 | 5/1983 | Kirchoff, Jr. | 150/1.5 R |
| 4,459,827 | 7/1984 | Rhodes | 62/457 |
| 4,516,409 | 5/1985 | Hobbs et al. | 62/457.5 |
| 4,741,176 | 5/1988 | Johnson et al. | 62/457.4 |
| 4,844,399 | 7/1989 | Harm | 248/311.2 |
| 4,889,267 | 12/1989 | Bolton | 224/274 |
| 4,908,248 | 3/1990 | Nakashima et al. | 62/530 X |
| 4,924,682 | 5/1990 | Penner | 62/372 |
| 4,974,741 | 12/1990 | Gustafson et al. | 220/85 |
| 4,989,767 | 2/1991 | Buschbom | 224/274 |
| 5,007,250 | 4/1991 | Musielak | 62/372 |
| 5,022,549 | 6/1991 | Beaver | 220/85 H |
| 5,095,718 | 3/1992 | Ormond et al. | 62/457.5 |
| 5,195,958 | 4/1992 | Patton | 215/100 R |

*Primary Examiner*—Henry A. Bennet
*Assistant Examiner*—William C. Doerrier
*Attorney, Agent, or Firm*—Allegretti & Witcoff, Ltd.

[57] ABSTRACT

This invention relates to a food and beverage cooler for use in conjunction with a golf bag. The cooler is easily attached to and detached from a standard golf bag. Additionally, the cooler is equipped with a cooling medium which allows for uniform cooling throughout the interior of the golf bag cooler.

20 Claims, 3 Drawing Sheets

FIG. 2
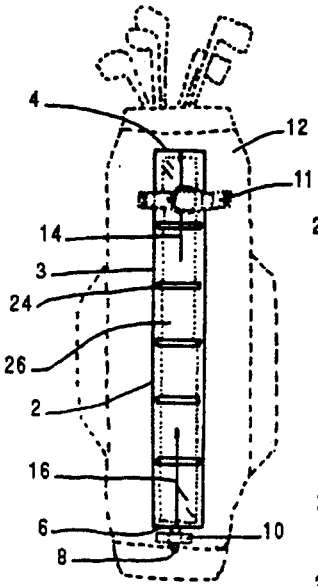
FIG. 1
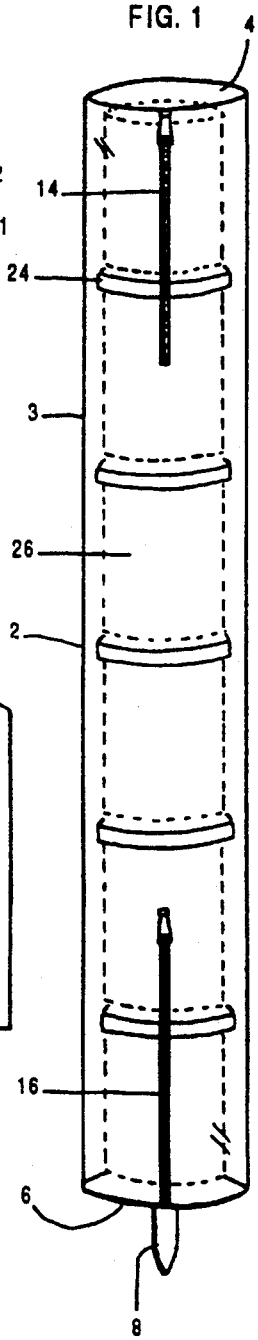
FIG. 3
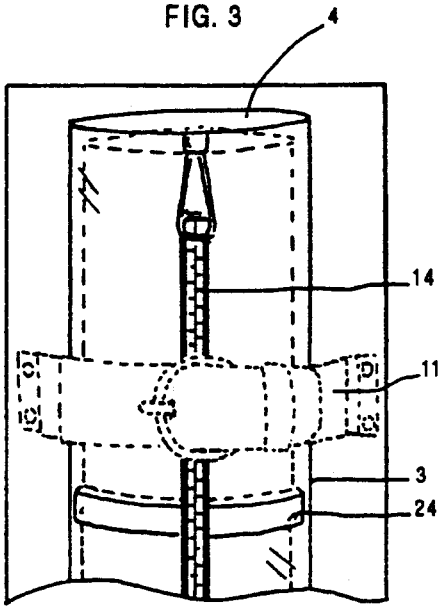
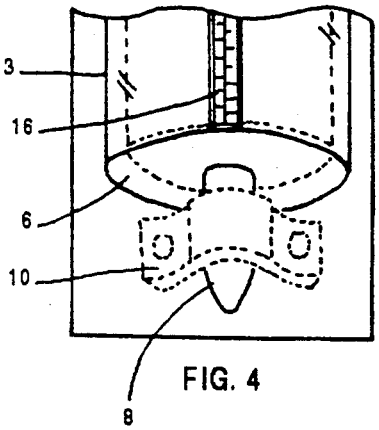
FIG. 4
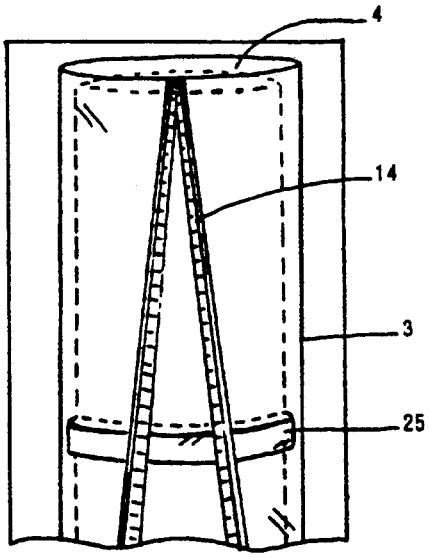
FIG. 5

FIG. 9
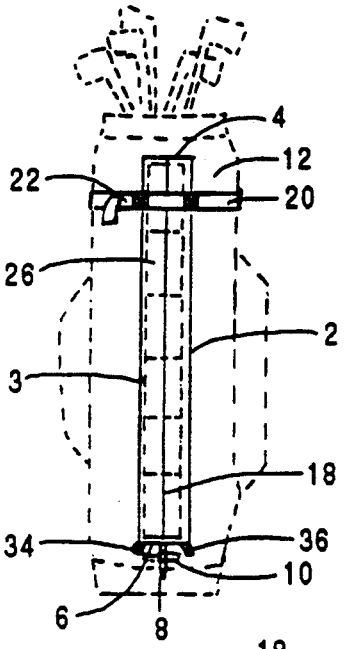
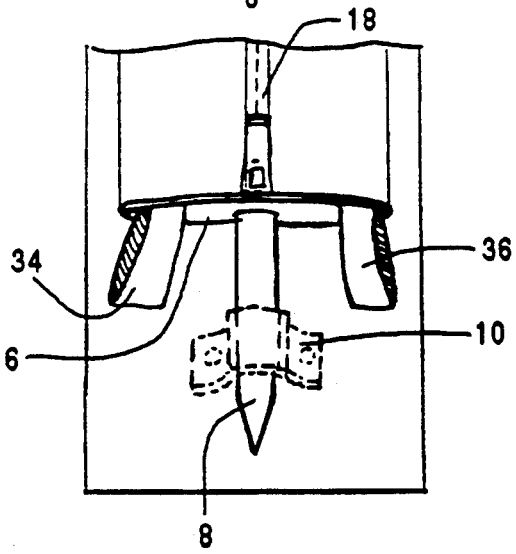
FIG. 11
FIG. 10
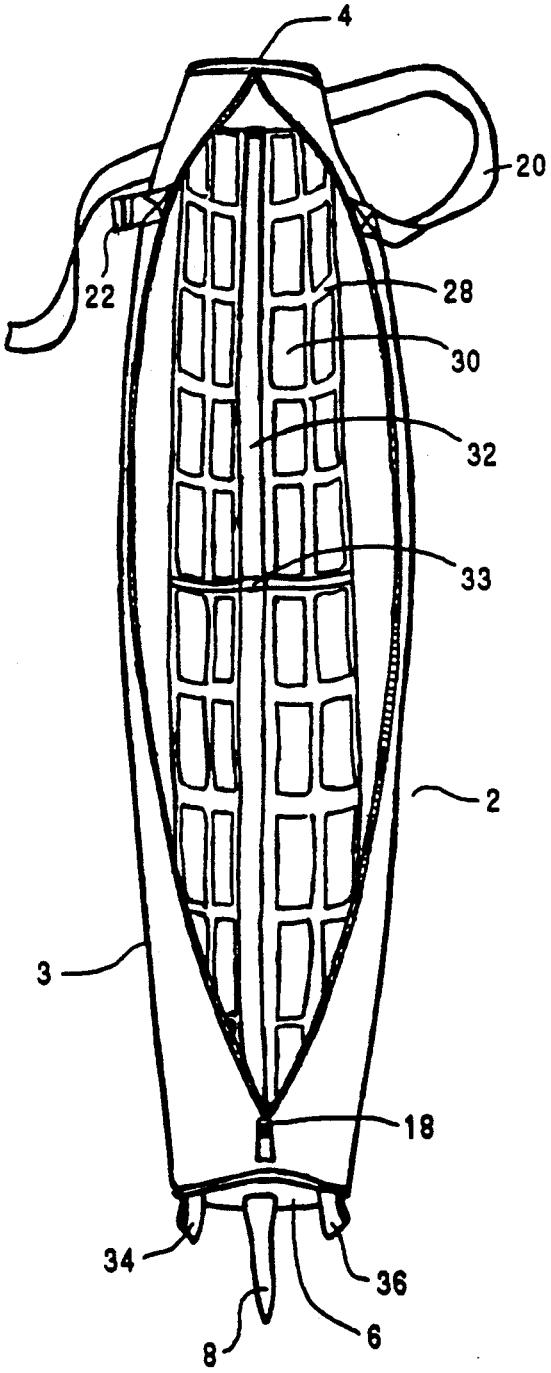

GOLF BAG COOLER

RELATED APPLICATIONS

This application is a continuation-in-part application of U.S. patent application Ser. No. 07/930,207 filed on Aug. 13, 1992.

FIELD OF THE INVENTION

This invention generally relates to food and beverage coolers. More particularly, this invention relates to a cooler for food and beverages which is suitable for use in conjunction with a golf bag. The cooler of the present invention is constructed so that it is easily attachable to a standard golf bag, and provides a cooling medium for uniformly cooling enclosed food or beverages.

BACKGROUND OF THE INVENTION

The availability of cold food and beverages on most golf courses is extremely limited. Therefore, it has been desirable for people to carry their own food and beverages while golfing. This poses certain problems because carrying extra coolers can be an enormous burden while using a pull cart or carrying a golf bag and clubs for nine or eighteen holes. Therefore, the present invention is directed towards a small, lightweight cooler which can be attached to a golf bag, and carried easily while playing golf.

Various types of food and beverage coolers are known in the prior art. Indeed, several beverages containers for attachment to a golf bag or a golf bag cart have been proposed in the prior art. However, none of the prior art references known to the applicant suggest the unique apparatus of the present invention which is easily attachable and detachable to a golf bag, and which provides a means for uniformly cooling food and beverages located within the cooler.

The prior art contains several examples of devices directed towards carrying beverages for use during a game of golf. For example, U.S. Pat. No. 3,899,098 issued to Hutchins on Aug. 12, 1975 discloses a portable insulated carrier for containers. This patent discloses the use of a cylindrical beverage container which is attachable to a golf bag through the use of a projection that engages the umbrella holder of a golf bag, and a clip that may be clipped or strapped onto the golf bag.

Several other patents have described devices for carrying beverages attached either to a golf cart or a golf bag. Examples of such patents are U.S. Pat. No. 3,938,869, U.S. Pat. No. 4,383,563, U.S. Pat. No. 4,844,399 and U.S. Pat. No. 5,105,958.

Several other references disclose the use of coolers which may be attached to a golf bag or golf cart for use while golfing. U.S. Pat. No. 4,459,827 issued to Rhodes on Jul. 17, 1984 discloses a golf bag cooler kit which uses a belt and mounting plate assembly to attach a small cooler to the upper portion of a golf bag.

U.S. Pat. No. 4,889,267 issued to Bolton on Dec. 26, 1989 discloses a cooler caddy used for mounting a beverage cooler to a pull-type golf cart. The cooler caddy provides a structure for holding a separate cooler.

U.S. Pat. No. 4,924,682 issued to Penner on May 15, 1990 discloses a golf bag beverage cooler. This cooler is secured to a golf bag through the use of upper and lower straps. Additionally, the cooler has a sliding means for dispersing cooled beverages.

U.S. Pat. No. 4,989,767 issued to Buschbom on Feb. 5, 1991 discloses a releasably mounted cooler for the front end of a motorized golf cart.

While several references disclose beverage containers or coolers for use in conjunction with a golf bag, golf cart or motorized golf cart, none of the references currently known to the applicant disclose applicant's simple apparatus for mounting a cooler onto a golf bag and providing a uniform cooling means for the contained food or beverages, as is disclosed by the present invention.

SUMMARY OF THE INVENTION

The present invention is directed towards a cooler which may be simply attached to and detached from a golf bag. The golf bag cooler of the present invention comprises an elongated, cylindrical body having a top end and a bottom end. The bottom end of the cooler is equipped with a protrusion for engagement with the umbrella holder of a golf bag. The top end of the cooler is attached to a golf bag either by equipment already existing on the golf bag, or by a supplementary supporting strap on the golf bag cooler.

The interior of the cooler is accessed through the use of at least one opening in the cooler. The opening can be closed through the use of a fastener. The opening and fastener, working in conjunction, provide easy access to the interior of the cooler and allow for easy unloading and loading of food or beverages.

The interior of the cooler is equipped with a cooling medium to cool the contained food or beverages. The cooling medium is capable of uniformly cooling the enclosed food or beverages. Therefore, the cooler is capable of securing the cooling medium so that the beverages at the top of the cooler are kept at a similar temperature to those at the bottom.

It is an object of the present invention to provide a cooler which is attachable to a golf bag.

It is a further object of the present invention to provide a vertical cooler which can uniformly distribute cooling to all contained food and beverages within.

It is another object of the present invention to provide a golf bag cooler which can be easily accessed for adding and removing food or beverages.

It is another object of the present invention to provide a golf bag cooler which contains easily removable cooling means which are reusable.

It is another object of the present invention to provide a golf bag cooler which is easily converted to a general recreational cooler.

Other objects and advantages of the present invention will be illustrated by the detailed description of the present invention.

BRIEF DESCRIPTION OF THE DRAWINGS

FIG. 1 is a front view of a golf bag cooler made in accordance with the present invention. Additionally, it illustrates the placement of beverages within the golf bag cooler;

FIG. 2 shows the golf bag cooler of FIG. 1 as it would be attached to a golf bag;

FIG. 3 shows a view of the upper portion of the golf bag cooler of FIG. 1 as it would be attached to a golf bag;

FIG. 4 shows a view of the lower portion of the golf bag cooler of FIG. 1 as it would be attached to a golf bag;

FIG. 5 illustrates the upper portion of the golf bag cooler of FIG. 1 in its open position;

FIG. 9 shows a golf bag cooler made in accordance with the present invention as it would be attached to a golf bag;

FIG. 10 shows the golf bag cooler of FIG. 9 opened to illustrate the interior; and FIG. 11 shows a view of the lower portion of the golf bag cooler of FIG. 9 as it would be attached to a golf bag.

DETAILED DESCRIPTION OF THE PRESENT INVENTION

Figure 6:
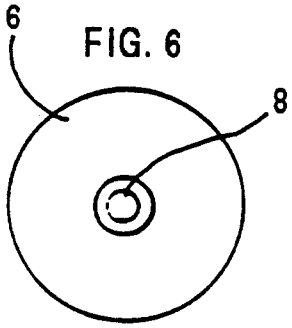
FIG. 6 shows a bottom view of a golf bag cooler made in accordance with the present invention.
Figure 8:
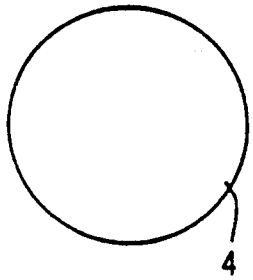
FIG. 8 is a top view of a golf bag cooler made in accordance with the present invention.
Figure 7:
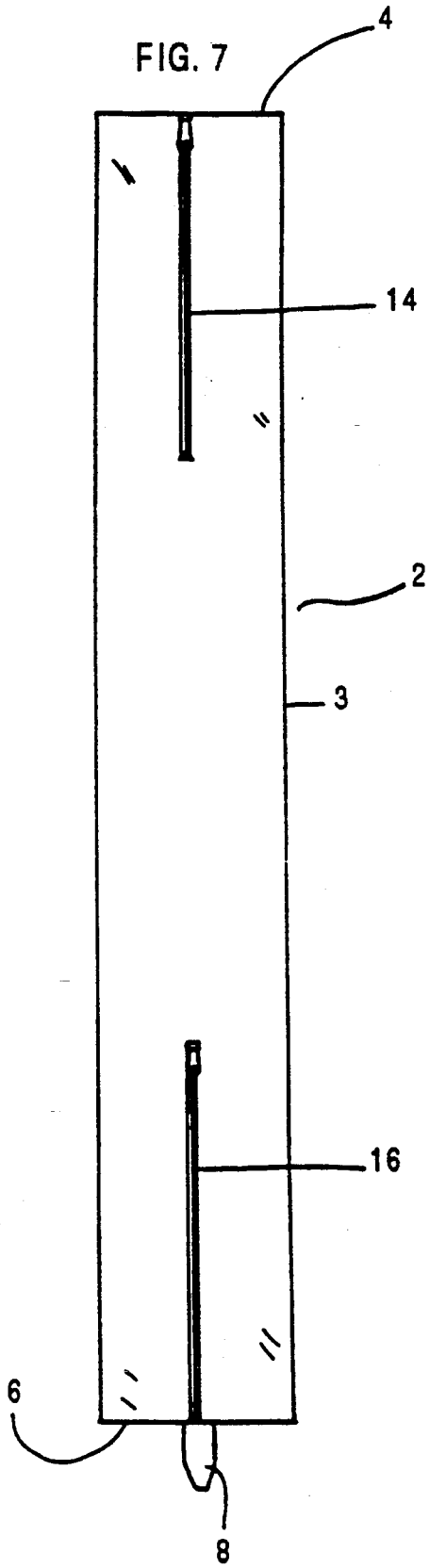
FIG. 7 is an exterior view of a golf bag cooler made in accordance with the present invention from the front.

FIGS. 1–11 illustrate two embodiments of a golf bag cooler made in accordance with the present invention. These figures depict the currently preferred embodiments of the present invention, and are not meant to limit the claims in any way.

Referring now to FIGS. 1–11, the present invention is directed towards a golf bag cooler 2 for use in conjunction with a golf bag 12. The golf bag cooler 2 includes a cylindrical housing 3, a top end 4 and a bottom end 6. The cylindrical housing 3 is preferably composed of three layers of material, although single layers or other multiple layers of material are appropriate.

In a preferred embodiment, the cylindrical housing 3 has an inner layer that should not be affected by exposure to cold, such as a polypropylene material or a water resistant nylon; a middle layer that is preferably an insulated foam padding; and an outer layer that can be chosen to the users taste and is preferably a water resistant material such as various grades of nylon or leather. The materials used for each of the layers are preferably flexible lightweight materials. The flexibility allows for easy storage of the golf bag cooler 2 and the lightweight material allows for easy transport. However, many known materials are appropriate for use in connection with the present invention. For ease of manufacture, the top end 4 and bottom end 6 are preferably composed of the same material as cylindrical housing 3.

Cylindrical housing 3 is preferably approximately three feet long, having a diameter of approximately three and one half inches. These dimensions allow the cylindrical housing 3 to hold six, twelve ounce canned beverages. Coolers of larger and smaller sizes may be constructed in accordance with the present invention.

Cylindrical housing 3 has an interior and an exterior. Cylindrical housing 3 defines an opening to allow access to the interior of the cylindrical housing 3, and is equipped with a fastener to unite the opening and deny access to the interior of the cooler. In a preferred embodiment, shown in FIG. 1, the cylindrical housing 3 defines two openings. In such an embodiment, the fastener comprises two zippers 14 and 16.

Alternatively, in another preferred embodiment, as depicted in FIGS. 9 and 10, the cylindrical housing defines an opening which comprises a longitudinal slit from the top end 4 to the bottom end 6. In such an embodiment, the fastener comprises a single zipper 18 that runs from the top end 4 of the golf bag cooler 2 to the bottom end 6. Many other fasteners known in the prior art are suitable for this invention, such as buttons, snaps, and hook and loop tape such as that manufactured by Velcro U.S., Inc. and sold under the trademark VELCRO®.

Bottom end 6 is equipped with a protrusion for engaging an umbrella holder 10 of golf bag 12. In a preferred embodiment, the protrusion comprises a spike 8 which slips through the umbrella holder 10. Spike 8 is designed to mimic the tip of an umbrella, and engage the umbrella holder 10 of a golf bag 12 as depicted in FIGS. 2, 4, 9 and 11. The spike 8 may be removable to allow use of the golf bag cooler 2 independent of the golf bag 12.

In a preferred embodiment, the golf bag cooler 2 is equipped with a support for supporting the cylindrical housing 3 to golf bag 12 at the top end 4 of the golf bag cooler 2. As depicted in FIGS. 9 and 10, the support may comprise a supporting strap 20 and buckle 22 which are directly connected to the golf bag cooler 2. The supporting strap 20 encircles the golf bag 12, and is tightened through the buckle 22. Thus, golf bag cooler 2 is supported at its top end 4 by the supporting strap 20 and buckle 22 and secured at the bottom end 6 by spike 8.

Alternatively, as depicted in FIGS. 2 and 3, the golf bag cooler 2 may be supported by the golf bag 12 through the use of a strap 11 which is already part of the golf bag 12.

In use, golf bag cooler 2 is equipped with cooling units for keeping an interior food or beverage cold. The cooling units are comprised of a cooling medium enclosed within a cooling package. The cooling medium may be any medium that is useful for cooling beverages or food. Such materials are common in the prior art. The most preferred materials are those which can be refrozen and reused. The cooling medium is enclosed within cooling packages. The cooling packages are composed of a material suitable for containing a cooling medium.

The cooling units are adapted to be inserted into the interior of cylindrical housing 3. In a preferred embodiment, the cooling units are removable from the interior of the cylindrical housing 3, so that they can be refrozen and reused without the need to place the entire golf bag cooler 2 in the freezer. As depicted in FIGS. 1 and 2, the cooling units may be cooling disks 24. In this embodiment, the cooling disks 24 are placed between beverage cans 26. If the golf bag cooler 2 is used to store food, the cooling disks 24 would be placed between the food. The cooling disks 24 may either rest on top of the food and beverages to be cooled, or they may be supported by projections extending inwardly from the interior of the cylindrical housing 3.

In another preferred embodiment, illustrated in FIG. 10, the cooling units are cooling packs 28. The cooling packs 28 are rectangular in shape and are comprised of a plurality of individual cooling cubes 30. In this embodiment the cooling packs 28 are removable and foldable so that they may be easily carried and stored in a freezer.

The cooling packs 28 are kept in place in the interior of the cylindrical housing 3 by a retainer. The retainer is preferably a retaining strap 32 which runs through the interior of the cylindrical housing 3 from the top end 4 to the bottom end 6. The retaining strap 32 is preferably affixed to the interior of the cylindrical housing 3 at the top, bottom, and also in at least one place in between 33. The cooling packs 28 are placed between the retaining strap 32 and the interior of the cylindrical housing 3 so that they do not shift during movement of the cooler.

The use of the cooling disks 24 or the cooling packs 28 in conjunction with the retaining strap 32 allow for equal cooling over the entire length of the golf bag cooler 2 even when the golf bag cooler 2 is in a vertical position. This is preferable so that food and beverages at the top of the cooler remain relatively cool as do those at the bottom of the cooler.

The golf bag cooler 2 can also be equipped with one or more supplemental umbrella holders 34 and 36, as depicted in FIGS. 9–11. The golf bag cooler 2 of the present invention is adapted to attach to a golf bag 12 through its umbrella holder 10. Therefore, in order to make it possible to carry an umbrella while using the golf bag cooler 2 of the present invention, supplemental umbrella holders 34 and 36 are provided at the bottom end 6 of the golf bag cooler 2. These supplemental umbrella holders 34 and 36 are preferably looped to accept the tip of an ordinary golf umbrella. In a preferred embodiment, two supplemental umbrella holders 34 and 36 are provided so that an attached umbrella can rest on either side of the golf bag cooler 2. This is preferred because many golf bags are equipped with umbrella sleeves which could be on either side of the golf bag cooler 2.

In a preferred embodiment, the golf bag cooler 2 is equipped with a handle for carrying the golf bag cooler 2 independent of the golf bag 12. The handle can be placed anywhere on the golf bag cooler 2, but is preferably located on the cylindrical housing 3. In a preferred embodiment, referring now to FIGS. 9–11, the supporting strap 20 can be used as the handle. The supporting strap 20 is accepted through one of the supplemental umbrella holders 34 or 36. The supporting strap 20 is equipped with a fastener such as a snap, button or hook and loop tape. The fastener allows the supporting strap 20 to be secured through the supplemental umbrella holder 34 or 36. In this manner, the supporting strap 20 runs longitudinally from the top end 4 to the bottom end 6 to allow for easy carrying of the golf bag cooler 2. In this embodiment, the golf bag cooler 2 can be used as a general recreational cooler. Additionally, in this embodiment, the spike 8 should be removable to allow for use of the cooler without the spike 8.

The present invention has been described with reference to certain preferred embodiments. It will, however, be clear to those skilled in the art that other embodiments can be constructed within the limits of the following claims.

I claim:

1. A golf bag cooler comprising:
- a hollow cylindrical housing having an interior and an exterior, the hollow cylindrical housing further defining an opening for accessing the interior of the hollow cylindrical housing and a fastener for closing said opening;
- a top end;
- a bottom end;
- a protrusion associated with the bottom end, complimentary to an umbrella holder of a golf bag; and
- at least one supplemental umbrella holder.

2. The golf bag cooler of claim 1, wherein the opening comprises at least one longitudinal slit between the top end and the bottom end.

3. The golf bag cooler of claim 1, wherein the fastener is a zipper.

4. The golf bag cooler of claim 1, including cooling units contained within the interior of the hollow cylindrical housing.

5. The golf bag cooler of claim 4, wherein the cooling units comprise a plurality of cooling disks placed between food and beverages contained within the interior of the cylindrical housing.

6. The golf bag cooler of claim 4, wherein the cooling units comprise a plurality of cooling packs, each cooling pack comprising a plurality of individual cooling cubes, the cooling packs being retained along the interior of the cylindrical housing by a retainer.

7. The golf bag cooler of claim 6, wherein the retainer comprises at least one retaining strap fixedly attached to the interior of the cylindrical housing at the top end, the bottom end and at least one location between the top end and the bottom end.

8. The golf bag cooler of claim 1, including a support for supporting the top end of the cylindrical housing to the golf bag.

9. The golf bag cooler of claim 8, wherein the support comprises a supporting strap and a buckle, the supporting strap and the buckle being fixedly attached to the exterior of the cylindrical housing, whereby the supporting strap can be wrapped around the golf bag and tightened through the buckle.

10. The golf bag cooler of claim 1 equipped with a handle to allow carrying of the golf bag cooler independent of a golf bag.

11. The golf bag cooler of claim 1 wherein the protrusion is removable from the golf bag cooler.

12. A golf bag cooler comprising:
- a hollow cylindrical housing having an interior and an exterior, the hollow cylindrical housing further defining an opening for accessing the interior of the hollow cylindrical housing and a fastener for closing said opening;
- a top end;
- a bottom end; and
- a protrusion associated with the bottom end, that is removable from the golf bag cooler, and is complimentary to an umbrella holder of a golf bag.

13. The golf bag cooler of claim 12, including cooling units contained within the interior of the hollow cylindrical housing.

14. The golf bag cooler of claim 13, wherein the cooling units comprise a plurality of cooling packs, each cooling pack comprising a plurality of individual cooling cubes, the cooling packs being retained along the interior of the cylindrical housing by a retainer.

15. The golf bag cooler of claim 12, including a support for supporting the top end of the cylindrical housing to the golf bag.

16. The golf bag cooler of claim 12 equipped with a handle to allow carrying of the golf bag cooler independent of a golf bag.

17. A golf bag cooler comprising:
- a hollow cylindrical housing having an interior and an exterior;
- a top end;
- a bottom end, the hollow cylindrical housing further defining a longitudinal opening for accessing the interior of the hollow cylindrical housing, the longitudinal opening extending substantially from the top end to the bottom end, the hollow cylindrical housing also including a zipper for alternatively providing or denying access to the interior of the cylindrical housing through the opening;

a protrusion associated with the bottom, complimentary to an umbrella holder of a golf bag;

a plurality of cooling packs, each cooling pack comprising a plurality of individual cooling cubes, the cooling packs being retained along the interior of the cylindrical housing by at least one retaining strap fixedly attached to the interior of the cylindrical housing at the top end, the bottom end and at least one location between the top end and the bottom end;

a supporting strap and a buckle, the supporting strap and the buckle being fixedly attached to the exterior of the cylindrical housing, whereby the supporting strap can be wrapped around the golf bag and tightened through the buckle; and at least one supplemental umbrella holder fixedly attached to the bottom end.

18. The golf bag cooler of claim 17, wherein the protrusion is removable from the golf bag cooler.

19. The golf bag cooler of claim 17, wherein the supporting strap is equipped with a fastener to allow attachment of the supporting strap to the supplemental umbrella holder, whereby the golf bag cooler can be carried independently of a golf bag and used as a general recreational cooler.

20. The golf bag cooler of claim 18, wherein the supporting strap is equipped with a fastener to allow attachment of the supporting strap to the supplemental umbrella holder, whereby the golf bag cooler can be carried independently of a golf bag and used as a general recreational cooler.

* * * * *